United States Patent [19]

Barber, Jr.

[11] Patent Number: 5,053,107

[45] Date of Patent: Oct. 1, 1991

[54] CERAMIC STAPLE FIBER AND GLASS FIBER PAPER

[75] Inventor: Charles R. Barber, Jr., Brookfield, N.H.

[73] Assignee: Lydall, Inc., Manchester, N.H.

[21] Appl. No.: 650,620

[22] Filed: Feb. 5, 1991

Related U.S. Application Data

[63] Continuation-in-part of Ser. No. 80,394, Jul. 29, 1987, abandoned.

[51] Int. Cl.[5] ..... D21H 13/36

[52] U.S. Cl. ..... 162/145; 162/149; 162/152; 162/153; 162/156

[58] Field of Search ..... 162/145, 152, 153, 156, 162/149

[56] References Cited

U.S. PATENT DOCUMENTS

| | | | |
|---|---|---|---|
| 2,692,220 | 10/1954 | Labino | 162/156 |
| 2,772,157 | 11/1956 | Cilley et al. | 162/145 |
| 3,749,638 | 7/1973 | Renaud et al. | 162/156 |

*Primary Examiner*—Peter Chin

*Attorney, Agent, or Firm*—Griffin Branigan & Butler

[57] ABSTRACT

There is provided a high temperature resistant, insulating inorganic paper for use in high temperature environments. The paper containing a combination of staple ceramic fibers and staple glass fibers interlocked together into a shape sustaining form and having a thickness of from 10 mils to 1 inch. The glass fibers content is from about 0.5 to 10% and the average diameter of the glass fibers is up to about 50 microns.

10 Claims, 1 Drawing Sheet

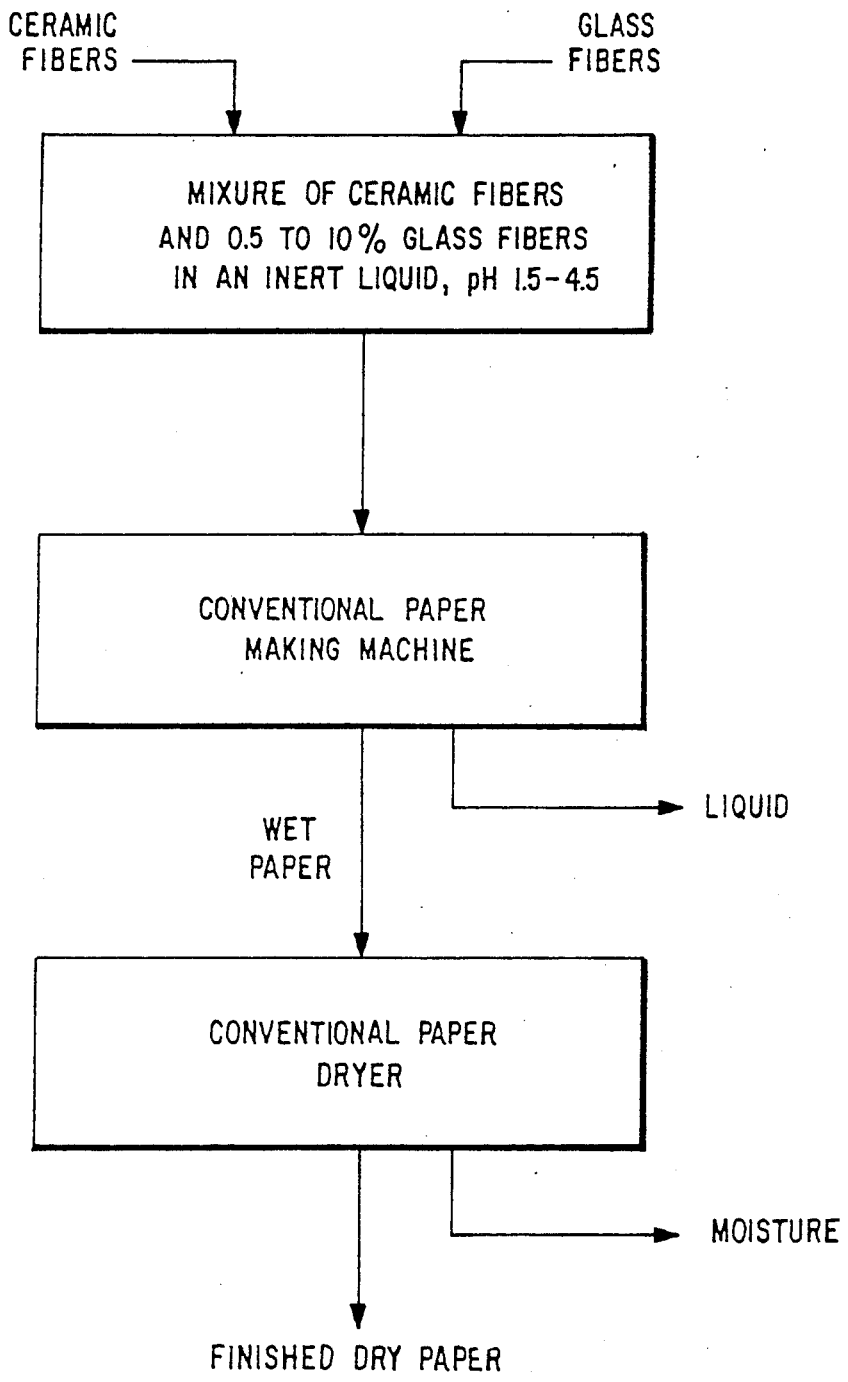
CERAMIC FIBERS
GLASS FIBERS
MIXURE OF CERAMIC FIBERS AND 0.5 TO 10% GLASS FIBERS IN AN INERT LIQUID, pH 1.5-4.5
CONVENTIONAL PAPER MAKING MACHINE
LIQUID
WET PAPER
CONVENTIONAL PAPER DRYER
MOISTURE
FINISHED DRY PAPER

CERAMIC STAPLE FIBER AND GLASS FIBER PAPER

This application is a continuation-in-part of U.S. Pat. application Ser. No. 080,394 filed July 29, 1987, now abandoned.

The present invention relates to high temperature resistant, insulating inorganic papers for use in high temperature environments occasioned in industrial processes. More particularly, the invention relates to such papers with improved processing strengths, improved finished strengths, and being free of organic material.

BACKGROUND OF THE INVENTION

In many industrial processes, high temperatures are encountered by the apparatus used in those processes. Those temperatures are so high that continued contact of the material being processed with the apparatus causes substantial deterioration of the apparatus. In such cases, a high temperature resistant, insulating inorganic paper is used to protect the apparatus from the high temperatures. While these materials are referred to in the art as "papers", since they resemble wood pulp papers in that they are composed of interlocked staple fibers, these papers are not made of organic fibers but are made of inorganic fibers, particularly certain types of ceramic fibers. In addition, these papers are made on conventional paper making machines and in that sense are also similar to wood pulp papers.

Examples of applications of the present papers are where the papers are used to line a rotary kiln so that the paper is disposed between the steel kiln shell and the fire bricks of the kiln to protect the shell. Another example is where the papers are used to line a metal trough which carries molten metal. As can be appreciated from these examples, the papers must be very high temperature resistant, but must also be capable of being configured during installation of the papers in the apparatus into different shapes which approximate the shape of the apparatus being protected. Unfortunately, however, since the papers are made of inorganic fibers, usually certain types of ceramic fibers, as opposed to organic fibers such as cotton, wood pulp, wool, and plastic fibers, the fibers of the papers have relatively smooth exterior surfaces and are most often of relatively short staple length. As a result thereof, when the inorganic fibers are interlocked together to form a paper, the interlocking of the relatively smooth exterior surfaced fibers is not nearly as great as the interlocking achieved with organic fibers. This results in the paper being of relatively low strength, both during processing and in the finished form ready for installation in an apparatus. Due to this low strength, it is both difficult to process the papers and to configure the finished papers into a shape appropriate for the apparatus being protected. As noted above, the usual inorganic fibers are certain types of ceramic fibers and these ceramic fibers present particular problems in the above regards, since the interlocking of these ceramic fibers is particularly poor due to the rigid nature of those fibers and the very short staple lengths thereof.

In order to provide sufficient strength to these ceramic papers during both processing and configuration to apparatus, a binder is normally placed in the ceramic papers. More usually, this binder is placed in the ceramic fiber mix from which the paper is made so that the binder will improve the strength of the papers during the processing thereof. Otherwise, it is difficult to process the ceramic papers, and paper breaking during processing is a continual problem. In addition, since these ceramic papers are processed on ordinary paper making machines in a continuous manner, such breaking of the paper during processing considerably increases the cost of producing the papers, due to lost production and down time of processing equipment. The binder also increases the strength of the finished paper so it may be cut and configured, without substantial breaking, during application to an apparatus to be protected.

While inorganic binders have been proposed in the art, inorganic binders are not particularly effective, either in improving the strength of the papers during processing or in regard to configuring the papers in application to an apparatus to be protected. Accordingly, primarily, the art uses organic binders in the ceramic papers. These organic binders take a variety of forms, but primarily the binders are polymer compositions, such as compositions formed of phenolics, acrylics, epoxies, polyvinylchloride, polyvinylacetate/alcohol, and the like. These binders function quite satisfactorily to improve the structural integrity, and hence the strength, of the ceramic papers, when the papers are used at lower temperatures. However, when the papers are used in environments with temperatures at about the 300° to 400° F. range, these binders begin to lose their binding effect, with a concomitant loss of structural integrity. With continued use at these temperatures, the binders will lose essentially all of their binding effect and the structural integrity of the paper will then be essentially only that integrity provided by the interlocking of the ceramic fibers. At higher temperatures, these binders will very quickly burn away and the paper will have the structural integrity only of that provided by the interlocked ceramic fibers.

As a result thereof, when the ceramic papers are intended to be used in high temperature environments, i.e. environments where the temperature is about 400° F. or higher, the strength provided by these binders is very quickly dissipated, and it is necessary for other provisions to be made such that the ceramic papers, with the considerably decreased structural integrity, may nevertheless function for the insulating properties required. To achieve this end, various mechanical devices and like arrangements have been suggested in the art. For example, in rotary kilns, by placing the ceramic paper between the steel kiln shell and the fire bricks, in certain manners, the fire bricks can lock the ceramic paper to the kiln shell and hold it in place even after the binder has burned away and the ceramic paper has considerably reduced structural integrity. The binder, therefore, functions to allow the ceramic paper to be processed and subsequently configured to the shape of the kiln until locked in place, during rotation of the kiln, by the fire bricks. At that point, the reduced integrity of the ceramic paper will not be a substantial problem, even after the binder has completely burned away.

While the foregoing approach is quite prevalent in the art and is reasonably successful for certain applications, that approach has serious disadvantages in connection with a number of industrial processes. As is appreciated from the foregoing, during the initial operation of the apparatus, the binder burns away and the gases produced from the binder are first contained in the apparatus and, in time, dissipated therefrom. However, there are many industrial processes where organic combustion products cannot be tolerated. Thus, in those processes, when the binder is being burned away, the product of those processes is unacceptably contaminated with the combustion products of the organic binder. In such processes, ceramic papers with binders are totally unacceptable. However, without binders the ceramic papers, as noted above, are very difficult to produce and more difficult to configure to the apparatus to be protected without breaking or seriously damaging the ceramic paper.

Thus, it would be a significant advantage to the art to provide ceramic papers where the papers have improved structural integrities and strengths during processing and during configuration, but where those papers do not produce organic combustion products when used in high temperature environments. Heretofore, the art has not been able to provide such ceramic papers.

BRIEF DESCRIPTION OF THE INVENTION

The invention is based on several primary and several subsidiary discoveries. Firstly, it was discovered that a substantial increase in the strength and integrity of the ceramic papers during processing could be achieved when the ceramic papers contain a relatively small amount of certain staple glass fibers. These glass fibers provided substantial co-interlocking between the glass fibers and the ceramic fibers, such that the total interlocking of fibers produces a strength and structural integrity of the paper being processed that the paper may be processed on ordinary paper making machines without substantial breaking during processing, and in the absence of an organic binder. Similarly, it was found that the finished paper, containing the small amount of certain glass fibers, provided strengths and structural integrities sufficient to allow the papers, in the absence of an organic binder therein, to be adequately configured to apparatus to be protected by the paper. Thus, since the present finished papers have no organic matter therein, during operation of the apparatus, no organic combustion products are present, and the problem, noted above in connection with the prior art, is thereby avoided.

A second primary discovery in that the amount of the glass fibers in the ceramic paper must be at a relatively low level. It was found that if the glass fibers content exceeds about 10% by weight of the paper, then upon heating the paper to above the melting temperature of the glass fibers and then cooling, the papers become undesirably brittle and breakable. However, at least about 0.5% by weight of glass fibers is required to provide minimum increases in strength and structural integrity.

Thirdly, as a primary discovery, it was found that in order to achieve the increased strength and structural integrity of the finished ceramic paper, both during processing and in configuration, the glass fibers must be of a very small diameter, i.e. no more than about 50 microns, especially no more than about 10 microns. Larger diameter fibers do not provide the necessary increases in strength and structural integrity. On the other hand, there is no practical lower limit on the diameter of the glass fibers and the diameter may be as small as desired, e.g. as low as 0.01 micron.

As a subsidiary discovery, it was found that for best results the length of the staple glass fibers should be less than about 0.75 inch. Fibers much beyond this length are difficult to adequately mix with the ceramic fibers in producing the paper and the increased strength and structural integrity, for most applications, would not be sufficient. Lengths of the glass fibers of less than about 0.1 inch are preferred.

As a further subsidiary discovery, it was found that the best results were achieved when the glass fiber content of the paper is less than about 5%. Difficulties were found to exist upon high temperature heating and subsequent cooling of paper with glass fiber contents significantly above 5%. At percentages between about 5% and 10%, the paper, upon high temperature heating and then cooling, is still adequate for some applications, but for many other applications, the cooled paper will be too brittle for many uses.

As a further subsidiary discovery, it was found that in producing the paper, due to surface properties of the glass fibers, the mixture of the ceramic fibers and glass fibers must be an inert liquid at a relatively low pH, i.e. a pH of about 1.5 to 4.5. Otherwise, sufficient intermixing of the glass fibers and the ceramic fibers does not result, and the increase in strength and structural integrity of the finished paper is not as desired.

Finally, it was discovered that in order to provide the present improved properties of the papers, all of the fibers used, including the ceramic fibers, must be staple fibers, as noted above. In this regard, the term "staple" fibers has the usual meaning in the art, i.e. the length and diameter of the fibers are sufficient that the fibers can be twisted into a yarn (indicating the ability of the fibers to interlock together). For the ceramic fibers useful in the present invention, as more fully identified below, this means the average fiber length must be about at least about 200 microns and up to about 1 inch, and the average diameter of the fiber is at least about 0.1 micron and up to about 0.01 inch, which are typical dimensions for conventional man-made ceramic fibers used in making conventional ceramic papers. This should be contrasted, for example, with the well known naturally occurring chrysotile asbestos fibers, which are of colloidal size in both length and diameter (referred to as unit fiber), which are not useful in the present invention.

Thus, the invention provides a high temperature resistant, insulating inorganic paper for use in high temperature environments. The paper is a finished paper and consists essentially of certain man-made staple ceramic fibers and staple glass fibers interlocked together into a shape-sustaining form. This paper form may have the thicknesses of conventional ceramic papers, i.e. from about 10 to 500 mls or even much greater, e.g. 1 inch or more. The glass fibers content of the paper is from about 0.5 to 10%, and the average diameter of the glass fibers is up to 50 microns. The remainder of the paper is the ceramic fibers, and the paper is organic matter free.

In the method of producing the paper, the staple glass fibers are dispersed in an inert liquid at a lower acid pH to form a uniform dispersion thereof. The ceramic fibers are then mixed into the dispersion to form a uniform mixture thereof. That mixture is passed through a conventional paper making machine and deliquified to form a paper of the mixture of glass fibers and ceramic fibers. That paper is then dried into a shape-sustaining form.

THE DRAWING

The figure is a diagrammatic illustration of a preferred form of the process.

DETAILED DESCRIPTION OF THE INVENTION

In connection with the process of the invention, and referring to the drawing, a mixture of ceramic staple fibers and from about 0.5 to 10% of staple glass fibers, is dispersed in an inert liquid. Preferably, that inert liquid has a pH of about 1.5 to 4.5. In this regard, it has been found that the glass fibers are somewhat difficult to uniformly disperse in the ceramic fibers. If uniform dispersion of the glass fibers within the ceramic fibers is not achieved, then a large measure of the advantages of the invention is, likewise, not achieved. In order to promote the dispersion of the glass fibers in the ceramic fibers, the glass fibers are first dispersed in an inert liquid with a pH of about 1.5 to 4.5, more preferably about 2 to 4. The inert liquid can be any inert liquid, but water is quite convenient in this regard, and hereinafter the inert liquid will be referred to as simply "water". When the pH of the water is within the ranges described above and the glass fibers have been dispersed therein, the ceramic fibers are added and, then, a uniform dispersion of the glass fibers in the ceramic fibers can be achieved with normal mixing procedures. While it is possible, under certain conditions, to mix the glass fibers and the ceramic fibers in the water at the same time, it is difficult to achieve a uniform dispersion of the fibers with such co-mixing. Further, glass fibers require longer times for dispersion, and if these longer times are used when co-mixing with ceramic fibers, the ceramic fibers can be damaged and result in lower properties of the finished paper. For these reasons, first the glass fibers are mixed in the water and the ceramic fibers are then added to in the mixture of water and glass fibers. With this procedure, the mixture can be carried out without fear of damaging the ceramic fibers and in ordinary paper making equipment, e.g. a hydropulper. After sufficient mixing to ensure a uniform mixture of the glass fibers and the ceramic fibers, the mixture is passed to a conventional paper making machine.

In the paper making machine, the mixture is deliquified so as to form a mat of the fibers. The amount of deliquification will, of course, depend upon the amount of liquid used in preparing the mixture. However, generally speaking, the mixture will contain up to about 25% fibers, but more usually less than 5% fibers, with the remainder being the water. Percentages outside of this range could be used, if desired, but higher amounts of fiber may be more difficult to form into a uniform dispersion of the fibers in the water. Much lower percentages may be used, e.g. 0.01% or less, but this requires more water removal.

The paper making machine is operated under conditions to achieve sufficient deliquification of the mixture to form a mat of the fibers. These conditions will vary with the percent of fibers in the mixture, as explained above, and the temperature of the mixture. However, the mixture is conveniently made at room temperature, although temperatures from freezing to boiling could be used, if desired. Irrespective of the percentage of fibers in the mixture and the temperature thereof, the deliquification in the paper making machine should proceed until the fibers form a mat with sufficient strength to be handled by a conventional paper dryer. Generally speaking, in this regard, the wet mat will have a moisture content up to about 75% or greater, although with different conventional paper dryers, and with variations in the amount of glass fibers, percentages outside of this range may be used.

The wet mat is then passed to a conventional paper dryer. The dryer contains a series of heated cans for drying the wet mat into a dry finished paper of low moisture content. The dryer drives moisture from the wet mat to provide the dry finished paper. The drying temperature is not narrowly critical, and the cans can be heated from as little as about 150° F. to much higher temperatures, e.g. up to about 400° F. or higher, without any substantial effect on the ability to dry the wet mat into finished paper and without any substantial disruption of the process by tearing or the like. However, of course, the drying temperature must be below the softening or melting temperature of the glass fibers, since if these temperatures are exceeded, the glass fibers will be permanently deformed or melted into the ceramic fiber, and the cooled paper will be so brittle that it cannot be configured to the desired shapes of the apparatus in which the paper is employed. Thus, the drying temperature, for safety, should be kept below about 400° F. The dried paper is then collected as a finished paper. The finished paper should have a moisture content or less than 5%, e.g. less than 1%.

The foregoing is a brief description of a conventional paper forming process in regard to the apparatus and processing steps thereof. Thus, as can be appreciated, the invention is capable of being carried out with conventional apparatus and with conventional processing steps for making conventional ceramic paper. This is an important feature of the invention, since the advantages of the invention can be realized without the necessity of special apparatus and special processing steps, other than the use of the glass fibers, and the use of the acidified inert liquid.

The product is a paper containing a combination of staple ceramic fibers and staple glass fibers. These fibers are so interlocked together that the paper is of a shape-sustaining form and that form has sufficient strength that it can be configured and formed into a variety of shapes for use in protecting apparatus operating in high temperature environments. The thickness of the paper can vary considerably, e.g. 10 to 500 mls or greater, e.g. inch, without any difficulty in processing thereof. However, generally speaking, the paper will have a thickness of about 30 mls to 375 mls, and more usually about 60 mls to 250 mls, although papers outside of these ranges may be prepared if desired.

The glass fiber content of the paper will be from about 0.5 to 10%, although more usually the glass fiber content will be about 8% or less, and preferably about 5% or less, for the reasons explained in more detail below. On the other hand, if the glass fiber content is too low, difficulties will be encountered in processing the paper, and the paper will not have sufficient strength to be configured into useful shapes for protecting high temperature apparatus. Thus, while as little as about 0.5% glass fibers in the paper is sufficient for some purposes, more usually, the paper will contain at least 1% glass fibers, and more preferably at least 2% glass fibers. A preferred balance between strength of the paper and conservation of glass fibers, for the reasons explained more fully below, is about 3% glass fibers in the paper.

In this latter regard, as can be easily appreciated, in some application of the high temperature resistant papers, the temperature environment of those applications will exceed the temperature at which glass fibers in the paper melt, e.g. in excess of about 1000° F. especially about 1200° F. Thus, in use, the ceramic paper may experience such temperatures that the glass fibers in the paper will melt. It would have been expected that the melted glass would cause considerable difficulty in the high temperature resistant paper because of the flow of the melted glass therefrom. However, most unexpectedly, it has been found that the melted glass tends not to collect as a puddle or the like but tends to distribute itself among the staple ceramic fibers, presumably by at least partially wetting the ceramic fibers, if the glass fiber content is at or below about 10% by weight. On the other hand, and again most unexpectedly, the melted glass does not appear to coat the ceramic fibers at this glass fiber content. This is evidenced by the paper remaining flexible after the glass fibers have been melted and the paper then cooled. If the glass coated the ceramic fibers, then it would be expected that the paper would be stiff and brittle after cooling. Investigations in this regard on papers which have been heated to above the melting point of the glass fibers and then cooled show that the glass is distributed among the ceramic fibers, mainly, as discrete small globules. These are very unexpected, but most important, actions of the melted glass in the present paper.

However, there are limits to the amount of glass fibers that can be contained in the paper and still function in the manner described above. As noted above, at about a 10% glass fibers content, apparently, the amount of melted glass is so great that it is no longer capable of fully distributing itself among the ceramic fibers, in the manner described above. Thus, on cooling, the paper tends to become somewhat stiff and brittle, although it can still be flexed without cracking. Indeed, glass fiber contents up to 20% will still allow some very limited flexure of the heated and cooled paper, but the flexure is so limited that practical utility of the paper no longer exists. For this reason, no more than about 10% of the glass fibers will be used in the paper, and 10% of glass fibers should only be used in papers that will not undergo substantial re-configuration after a high temperature use and cooling. For more general use of the papers, especially in regard to the ability of the papers to be re-configured and used (after high temperature use and cooling) without cracking in substantially all circumstances, the content of the glass fibers should not be above about 8%, preferably no greater than about 5%.

However, on the other hand, if the content of the glass fibers in the papers is not sufficient, then the ceramic paper is very difficult to process, as discussed above, and the finished paper does not have sufficient strength to be fully configurable for use in protecting apparatus. A glass fibers content of about 0.5% will provide some increased processing strength to the paper and is, therefore, a benefit. However, to obtain substantial increases in the strength of the paper being processed, the glass fibers content should be at least about 2%.

Therefore, the preferred range of glass fibers is between about 2% and 5%, for the reasons explained above, with the optimum content being about 3%, bearing in mind increased processability and ease of re-configuration.

The diameter of the glass fibers also has an effect on both processing of the paper and configuration of the finished paper. Ordinary glass fibers will not function adequately for purposes of the present invention. Very small diameter fibers must be used to achieve these purposes. The glass fiber diameter may be up to about 10 microns, although some advantage of the invention can be obtained outside of this range, especially up to about 50 microns or so. As can be appreciated, at a particular percentage of glass fibers in the paper, e.g. 5%, the smaller the diameter of the glass fibers the more total surface area and total length thereof. Thus, with the small diameter glass fibers, a relatively small percentage in the paper, e.g. 5%, will still present considerable total lengths of the glass fibers in the paper. These increased total lengths of glass fibers provide the opportunity for the glass fibers to completely interlock in and among the ceramic fibers and provide additional strength to those ceramic fibers for processing and use of the paper. Further, with the small diameter fibers, they may be uniformly dispersed among the ceramic fibers and, upon melting, will provide a uniform dispersal of the melted glass, which is most important. It is for these reasons that small diameter fibers must be used in the invention. If larger, more conventional glass fibers are used, then the content of the glass fibers in the paper must be so high that the problems discussed above will be encountered, or, if the content of the larger conventional glass fibers is such that the problems associated with melting are avoided, the amount of fiber total length in the paper will be so small that the advantages in processing and configuration will not be achieved. For these reasons, usually the average diameter of the glass fibers will be no greater than 10 microns, especially no greater than 5 microns and preferably less than 1 micron. However, a good working range for the diameter of the glass fibers is from about at least 0.1 micron up to 10 microns.

The staple length of the glass fibers is also important to the invention. It is necessary, as explained above, to obtain a uniform dispersion of the glass fibers in the ceramic fibers. If the staple length of the glass fibers is too long, it is difficult to obtain a uniform dispersion, and without a uniform dispersion, the benefits of the invention will not be achieved. Thus, the glass fibers should have an average staple length less than 0.75 inch (19,000 microns) and more preferably no more than about 0.1 inch (2500 microns). On the other hand, if the staple length is too short, then there is not sufficient opportunity for the glass fibers to interlock in and among the ceramic fibers and the benefits of the invention will not be provided. Hence, the average staple length of the glass fibers should be at least about 100 microns and more preferably at least about 200 microns.

The fibers may also be further identified as a ratio of the length to the diameter. For example, a very useful glass fiber has an average length of 300 microns and an average diameter of 0.3 micron. Thus, the average length to diameter ratio (L/D) is 1000. Very useful L/D ratios are between 500 to 3000. Similar L/D ratios are also useful for the ceramic fibers. However, in order to achieve the sufficient interlocking of the fibers, as explained above, the L/D should be at least 100. There is, therefore, a balance between the length of the glass fibers to fully interlock among the ceramic fibers and the length of the glass fibers to achieve good dispersion. The preferred balance in this regard is where the average glass fiber length is about 0.5 inch (13,000 microns), or less, and a preferred fiber length is about 300 microns.

Accordingly, as explained above, the best balance of all of processing strength, dispersion of the glass fibers for mixing purposes, increased strength, configuration and re-configuration ability in the paper, and the avoidance of brittleness of a high temperature fluxed and cooled paper are provided when the average diameter of the staple glass fibers is up to about 0.3 micron, the average staple length of the glass fibers is up to about 300 microns, and the content of the glass fibers in the paper is up to about 3%. The term "glass fibers" means any of the ordinary staple glass fibers, e.g. E-glass or S-glass, or quartz glass fibers or borosilicate glass fibers.

As to the ceramic fibers, it will be appreciated that the ceramic fibers must be staple fibers. As can easily be appreciated, this is because the ceramic fibers must be capable of interlocking together and with the glass fibers to form the paper with sufficient strengths for process and configuration to apparatus, as explained above. With ceramic fibers of lengths and diameters outside of staple lengths and diameters, such interlocking will not take place and the fibers, even including the present amount of glass fibers, cannot be formed into a paper that can be processed on paper making machines and can be handled, much less configured to apparatus, without totally breaking apart.

The staple length and diameter of ceramic fibers varies with the particular ceramic, as is well known in the art. Man-made ceramic fibers can be controlled in length and diameter during manufacture, but, of course, the length and diameter of natural ceramic fibers cannot be controlled. Hence, the conventional ceramic papers are normally made with man-made ceramic fibers, as opposed to natural ceramic fibers, such as asbestos fibers. The lengths and diameters of natural asbestos fibers vary widely, depending on the source of those natural fibers. It is possible to make conventional ceramic papers with highly selected asbestos fibers, but such highly selected asbestos fibers are quite expensive and are, hence, not normally used in conventional ceramic papers. The highly-selected asbestos fibers are of staple lengths and diameters, i.e. have an average length of at least about 100 microns and an average diameter of at least about 0.5 micron. Thus, ordinary asbestos fibers, such as those used as fillers and insulations, are not of staple size and cannot be made into a conventional ceramic paper. Also, the more specialized asbestos fibers, such as colloidal chrysotile asbestos fibers (often referred to as asbestos fibrils), of course, are totally incapable of interlocking together since they are of colloidal size and not staple size and, therefore, cannot be formed into a paper of the present nature. Colloidal-sized chrysotile asbestos fibers , having a unit fiber of about 0.05 micron or less (i.e. neither the fiber diameter or fiber length is greater than 0.05 micron), are sometimes referred to as "spinning grade length" in that the colloidal-sized asbestos fibers have been used to coat and lubricate natural or synthetic fibers during spinning of those fibers into yarns.

In view of the foregoing, conventional ceramic papers are made of man-made ceramic fibers where the length and diameters thereof are controllable so as to produce staple ceramic fibers, although it is possible to make such papers with a natural ceramic fiber, such as the highly selected staple asbestos fibers, described above. However, in view of the expense and difficulty in ensuring selected natural fibers which are staple fibers, the present papers are made with man-made staple ceramic fibers. Thus, for purposes of the present specification and claims, the term "man-made" staple ceramic fibers means staple-size fibers manufactured in controlled fiber lengths and diameters and made of mineral wool, zirconia, titanate, alumino-silicate, silica, aluminosilicate chromia and alumina, and having a length of at least 200 microns, especially at least 300 microns and up to about 1 inch, especially up to about 0.1 inch and having a diameter of at least about 0.1 micron and up to about 0.01 inch.

It will be appreciated from the above that the present finished paper contains no organic material. In this regard, "finished" paper is that which has been produced on the paper making machine and dried at a temperature below 400° F., and before the paper is used or configured to an apparatus or been subjected to any other material processes or conditions, such as being subjected to temperatures above about 400° F. In this latter regard, as can be easily appreciated, it is possible to process the present papers with an organic material, such as an organic binder, so that the breaking strength of the paper being processed on a paper making machine is increased and, thus, avoids the problem of paper breaking during processing, as explained above. Thereafter, the organic material could be burned from the so-produced paper to render the burned paper free of organic material. However, to fully combust an organic material in the paper and leave no organic residue, even with the more labile organics, the burning temperature must exceed at least 400° F. and usually exceed at least 500° F., e.g. at least about 700° to 1000° F. or more for most organics. Thus, these temperatures necessary to render such a ceramic paper organic matter free will also be high enough to cause deformation, or softening, or melting of the glass fibers in the ceramic papers, and, upon cooling, such papers would be too stiff and/or brittle to be thereafter adequately configured to apparatus, as explained above, and thus not suitable according to the present invention.

For the above reasons, also, organic coated glass fibers cannot be used in making the present papers. For example, if conventional glass fibers, which are coated with conventional materials to improve the adherence to plastics and the like, such as coatings of phenolic, urea, melamine, polyester, acrylic, and the like, were used, it would be necessary to burn such papers at very high temperatures in order to combust those organics, i.e. temperatures in excess of 1000° F. or even 1200° F. or 1300° F. Such temperatures, as explained above, would cause softening and even melting of the glass in the present paper, and, upon cooling, the papers would be far too stiff and brittle to be configured to an apparatus, as explained above, and, hence, totally unsuitable for the present invention.

In view of the above, the paper composition being processed to the finished paper according to the present invention must contain no organic matter, i.e. be organic matter free, except possibly unintentional contaminates of organic matter. In this latter regard, for example, glass fibers are often processed (spun, wound, twisted, etc.) with an organic lubricant, such as a water-soluble surface active agent or soap. After processing, that lubricant is normally washed from the processed glass fibers. However, there may remain on the glass fibers relatively undetectable amounts of residual lubricant as unintentional contaminants. The amount of such residual contaminants is, however, insignificant.

Thus, for purposes of the present specification and claims, the term "organic matter free" means (1) that there is no intentionally added organics to any of the components of the paper, e.g. the man-made ceramic fibers or the glass fibers, (2) that there are no residual organics associated with the components of the paper, and (3) that there is certainly no polymeric organics, even contaminating residues thereof, such as the above-noted coatings on glass fibers, i.e. the finished paper is free of polymeric organics. The above (2) does not mean, however, that there cannot be any unintentionally contaminating residues of organics, as explained above, in regard to the processing agent or lubricants, but it does mean that the residues are insignificant, e.g. no more than one hundred parts of contaminating organic residues per million parts of the finished paper, by weight.

An important feature of the invention is even after the glass fibers have melted, for example in high temperature use of the finished paper, the melted glass remains dispersed within the paper. Therefore, the paper with melted and cooled glass can be reasonably re-configured, if desired, especially with the lower glass contents, as explained above.

The invention will now be illustrated by the following Examples, where all percentages and portions are by weight, unless otherwise designated, which is also the case in connection with the foregoing specification and following claims.

EXAMPLE 1

Approximately 400 gals. of water was placed into a Solvo pulper. 1800 mls of sulfuric acid were then added to the water and the pulper mixer was activated for approximately 2 seconds to mix the sulfuric acid into the water. One (1) pound of microglass fibers was added to the water/acid mix and the pulper mixer was again operated for about 2 minutes to uniformly disperse the glass fibers in the water/acid mix. Forty (40) pounds of ceramic fibers were added to the mix and the pulper mixer was again operated for about 25 seconds to disperse the ceramic fibers and provide a relatively uniform mix of glass fibers in the ceramic fibers.

The resulting slurry was transferred to a tank (pulper dump chest) and additional water was added to increase the volume of the slurry to approximately 1500 gals. and adjust the pH to about 3.0–3.5.

After mixing the slurry, the slurry was transferred to the machine chest and made ready for introduction of the slurry into a conventional paper making machine.

The mixed slurry was fed at a controlled rate to the paper making machine so as to allow the fibers of the slurry to be deposited on a moving, screen covered cylinder and to allow the water to pass through the screen. In conjunction with the screen cylinder was a vacuum which removed additional water from the forming wet mat.

The formed wet mat was then fed to a dryer with nine (9) heated calendar cans. The cans were heated to approximately 270° F. and the remaining water was evaporated from the wet mat.

The dried sheet, less than 1% moisture, was then wound onto a core for collection and storage.

The ceramic fibers used in this process were Manville 111 PG staple ceramic fibers (alumina-silica fibers). The glass fibers were Manville Code 100 microglass staple fibers. These glass fibers had an average diameter of approximately 0.3 micron and an average staple length of approximately 300 microns. The 40 pounds of ceramic fibers and 1 pound of microglass fibers (41 lbs. total) provide a glass fibers content of approximately 2.5% in the finished paper. The glass fibers have a melting point of approximately 1250° F.

The dried paper had a thickness of approximately 124 mls. It could be easily configured without breaking, e.g. rolled into a cylindrical shape, folded so that opposed edges touched, and pulled with a firm grasp without tearing or rupturing. Thus, the paper was quite capable of being configured to complicated shapes without breaking or tearing.

EXAMPLE 2

The procedure of Example 1 was repeated, with the exception that no glass fibers were used in the ceramic paper. While it was most difficult to process that paper, the product which was successfully processed tore readily with even the slightest grasp and pull. It had essentially no strength and could not be configured without substantial tearing or rupturing. This is the present conventional product without a binder.

EXAMPLE 3

The procedure of Example 1 was repeated, except that 10% of glass fibers were used and the average diameter of the glass fibers was about 7 to 8 microns.

The processing was satisfactory but the relatively high amount of glass fibers resulting in processing which was not as easy to operate as the processing of Example 1. The finished paper, while having improved strengths, was only marginally satisfactory from a configuration ability point of view. When heated to 2000° F. and cooled, the paper was stiff and somewhat brittle. While the paper could be configured into simple shapes, any complex configurations, e.g. folded such that opposed edges touched, caused the somewhat brittle paper to break.

EXAMPLE 4

Example 1 was repeated, except that 5% of the 0.3 micron glass fibers was used. The processing was satisfactory and the strength of the finished paper was also satisfactory. When the paper was heated to 2000° F. and cooled, the paper also became somewhat brittle, but it was satisfactory for most forming into relatively complex shapes for configuration purposes.

By way of comparison, a standard ceramic paper was processed essentially as in Example 1, but with an organic binder (8% acrylic polymers). The paper was heat fluxed at 1000° F., at which temperature the organic binder burned away and off-gassed. The paper was exceedingly weak and could hardly be handled without tearing or rupturing. It was not conducive to any further processing, such as slitting, die-cutting, shaping, etc., without being very easily damaged.

It will also be appreciated from the foregoing that the particular paper making process is not critical to the invention, and may be the conventional process as described above, or other of the conventional processes. Likewise, the temperatures for producing the papers, other than the drying temperature, are not critical and may be mainly chosen as desired.

Having described the invention, it will be appreciated that modifications thereof will be readily apparent to those skilled in the art, and it is intended that such modifications be included within the spirit and scope of the annexed claims.

What is claimed is:

1. A high temperature resistant, insulating inorganic paper for use in high temperature environments, said paper being a finished paper consisting essentially of (1) about 0.5 to 10% by weight of staple glass fibers having a diameter of up to about 50 microns, an average length from of less than about 0.75 inch and greater than about 100 microns and (2) the remainder being man-made, staple ceramic fibers having an average length of from about 200 microns to about 1 inch and an average diameter from about 0.1 micron to about 0.01 inch, wherein the said ceramic fibers and said glass fibers are interlocked together into a shape-sustaining paper form having a thickness of from 10 mils to 1 inch, and wherein the finished paper is organic matter free.

2. The paper of claim 1 wherein the average diameter of the glass fibers is up to about 5 microns.

3. The paper of claim 1 wherein the glass fibers content is up to about 5%.

4. The paper of claim 1 wherein the said average staple length of the glass fibers is up to about 0.05 inch.

5. The paper of claim 1 wherein the said average diameter of the staple glass fibers is about 0.3 micron, the said average staple length of the glass fibers is about 300 microns and the said content of the glass fibers is about 3%.

6. The paper of claim 1 wherein the ceramic fibers are alumina-silica fibers.

7. The paper of claim 1 wherein the ceramic fiber has a length of about 1 inch and a diameter of about 0.01 inch.

8. The paper of claim 1 wherein the paper has been subjected to temperatures not exceeding 400° F.

9. The paper of claim 1 wherein the ceramic fiber is made of mineral wool, zirconia, titanate, alumino-silicate, silica, aluminosilicate chromia, and alumina.

10. The paper of claim 1 where the length to diameter ratio of the fibers in the paper is between 500 and 3000.

* * * * *